US010710684B2

(12) United States Patent
Hagest

(10) Patent No.: US 10,710,684 B2
(45) Date of Patent: Jul. 14, 2020

(54) MULTI FLANGE DESIGN FOR MARINE INDUSTRY

(71) Applicant: Chris Daniel Hagest, Lake Havasu City, AZ (US)

(72) Inventor: Chris Daniel Hagest, Lake Havasu City, AZ (US)

(73) Assignee: EFFICIENT POWER DESIGN LLC, Lake Havasu City,, AZ (US)

( * ) Notice: Subject to any disclaimer, the term of this patent is extended or adjusted under 35 U.S.C. 154(b) by 0 days.

(21) Appl. No.: 16/246,907

(22) Filed: Jan. 14, 2019

(65) Prior Publication Data

US 2020/0017173 A1 Jan. 16, 2020

Related U.S. Application Data

(60) Provisional application No. 62/698,342, filed on Jul. 16, 2018.

(51) Int. Cl.
*B63B 34/10* (2020.01)
*B63B 71/00* (2020.01)

(52) U.S. Cl.
CPC ..... *B63B 34/10* (2020.02); *B63B 71/00* (2020.01); *B63B 2241/20* (2013.01)

(58) Field of Classification Search
CPC ... B63B 9/001; B63B 2241/20; B63B 35/731; B63B 34/10
See application file for complete search history.

(56) References Cited

U.S. PATENT DOCUMENTS 4,552,085 A * 11/1985 Eder ..... B63B 3/00 114/84
4,862,817 A * 9/1989 Hornsby, Jr. ..... B63B 1/042 114/67 A
4,875,426 A * 10/1989 Soga ..... B63B 35/731 114/123

* cited by examiner

*Primary Examiner* — Stephen P Avila
(74) *Attorney, Agent, or Firm* — Kutak Rock LLP

(57) ABSTRACT

A watercraft with improved safety and stability is provided. The watercraft includes a shell defining a plurality of raceways for receiving water during certain maneuvers of the watercraft, thereby excerpting force upon the watercraft in a first direction. The shell is configured so as to prevent or otherwise inhibit the water from excerpting an opposed second force upon the watercraft. An intermediate panel of the shell provides increased flexibility, thereby serving as a shock absorber for the watercraft.

19 Claims, 5 Drawing Sheets

PRIOR ART

MULTI FLANGE DESIGN FOR MARINE INDUSTRY

CROSS-REFERENCE TO RELATED APPLICATIONS

This application claims priority pursuant to 35 U.S.C. 119(e) to U.S. Provisional Patent Application Ser. No. 62/698,342, filed Jul. 16, 2018, the entire disclosure of which is incorporated herein by reference.

FIELD OF THE INVENTION

The invention relates generally to watercraft. More specifically, the present invention is concerned with a multi flange hull design.

BACKGROUND

Water sports are extremely popular, many of which require the use of watercraft, such as boats and personal watercraft. Traditionally, in order to obtain buoyancy, watercraft include a shell defining an interior volume, thereby allowing the watercraft to displace a volume of water. While shell designs are generally determined based on the draft of the watercraft, several factors must be considered. Unfortunately, current shell designs are unstable, and often unsafe, during certain maneuvers and/or water conditions, such as while banking in rough water. Consequently, it would be beneficial to have a shell design that increased stability and safety of the watercraft while banking and/or in rough water.

The majority of watercraft have a top deck and a bottom hull attached at a bond flange, with the traditional single bond flange defining an "L" shape that runs parallel to the side surface. This single flange design often fails to provide insufficient stability and/or grip. Consequently, it would be beneficial to have a more stable design, such as a multi flange design. More specifically, it would be beneficial to have a multi flange, lip, or surface that is parallel or similar angled surfaces where they are positioned one over the other in any shape or form creating a design that offers better performance in all water conditions.

Small watercraft is particularly susceptible to instability in rough water conditions. Consequently, it would be beneficial to have a system for and a method of increasing stability of small watercraft.

Watercraft can become unstable during aggressive banking or similar maneuvers. Stability is further compromised by existing flanges upon such flanges becoming completely submerged. For instance, any stability forces associated with flanges of the present invention ("stability" or "gripping" forces) are counteracted by an opposed instability force upon the flange being submerged ("instability" or "sticking" forces). Consequently, it would be beneficial to have a system for and a method of increasing stability of watercraft, such as by way of one or more stability force associated with one or more flange or the like, while avoiding instability of the watercraft, such as by avoiding an opposed instability force associated with one or more flange or the like.

In some instances, instability forces are a direct cause of a user overcompensation, such as in rough waters, during a turn, or otherwise. For instance, when banking for a turn, a user must lean into the turn (i.e. apply a "leaning" force) to overcome a stability/gripping force of the watercraft. When the instability/sticking force is applied, the leaning force must be reduced accordingly to prevent the watercraft from tipping over. Unfortunately, it is difficult to know precisely how much to reduce the leaning force and when the leaning force must be reduced. Failure to timely and sufficiently reduce the leaning force can cause the watercraft to tip over. Excessive reduction of the leaning force can cause loss of the instability/sticking force, often resulting in the watercraft slamming back to a level orientation. Similar issues can arise when trying to return a watercraft to an unbanked configuration, often requiring timely application of a sufficient amount of additional leaning force and/or a timely reduction of an opposed leaning force. Consequently, it would be beneficial to have a system for and a method of eliminating or otherwise reducing instability/sticking forces. Alternatively, or in addition, it would be beneficial to have a system for and a method of reducing risks associated with failure to timely and sufficiently reduce (or increase as the case may be) a leaning forces associated with generation (or reduction) of an instability/sticking force.

Constant impacts associated with watercraft of the prior art can cause harm or fatigue to users and/or the watercraft itself. Consequently, it would be beneficial to have a system for and method of reducing impacts and/or for reducing risks associated with impacts.

SUMMARY

The present invention comprises a watercraft having increased stability and/or safety during certain maneuvers and/or conditions and a method of increasing safety and/or stability during such maneuvers and/or in such conditions. In some embodiments, the system includes a multi-flange hull design, each flange being configured to grip the water, thereby providing a plurality of gripping surfaces. In some embodiments, each flange is vertically displaced from each of the other flanges, thereby providing incremental gripping actions, thereby providing incremental stability/gripping forces. In some embodiments, the watercraft is configured so as to reduce or eliminate instability/sticking forces, thereby further increasing stability and safety of the watercraft.

In some embodiments, a shell of the watercraft defines multilevel flange, such as a plurality of "L" shape or any horizontal or vertical shape that wraps around the watercraft. In some embodiments, at least part of one or more flange attaches to one or more side, front, and/or rear portion of the watercraft. In some embodiments, the watercraft includes several horizontal surfaces that circle the side wall or vertical surface of the watercraft like a ring. In some embodiments, the size and shape of such features varies.

Some embodiments of the present invention slow water from rushing up the side, front, and/or back of the watercraft. Some embodiments of the present invention are configured to allow water to stay on a flange or other surface longer, thereby creating better side to side stability and/or front to back stability. For instance, when water passes over a first parallel or similar angled surfaces, net pressure associated with the first surface is reduced and/or can become a negative pull. Having a second parallel or similar angled surface shadowing the first surface reduces that negative pressure. This advantage of multi level flanges; like in the shape of an "L", will create an advantage to passenger comfort in all types of water conditions. Furthermore, in some embodiments, structure of the present invention facilitates better handling for the watercraft (such as by reducing risks associated with reducing leaning fprces) and increases strength of the watercraft.

In some embodiments, the present invention includes one or more feature for reducing impact to one or more user of the watercraft. In some embodiments one such feature is an intermediate panel positioned between upper (deck) and lower (hull) portions of a shell of the present invention. In some embodiments, the intermediate panel is flexible and/or provides improved flexible properties relative to adjacent portions of the shell, thereby serving as a shock absorber for the shell.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION

Figure 1:
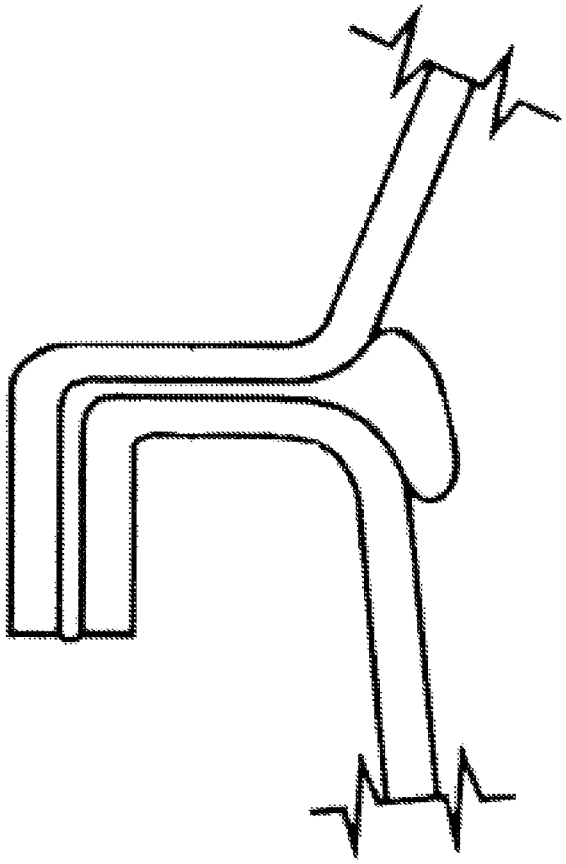
FIG. 1 is a prior art partial sectional view showing a bonding joint of the prior art.

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 2-5, the present invention includes a shell 100 for a watercraft, such as a personal watercraft. In some embodiments, the shell 100 includes a deck 110 forming a top portion of the shell 100 and a hull 120 forming a bottom portion of the shell 100. In some embodiments, a bottom lip 112 of the deck 110 is configured to engage with a top lip 122 of the hull 120, thereby forming a bonding joint. In some embodiments, the bonding joint includes a bonding flange 212, such as a generally vertical flange extending at least partially around the perimeter of the shell 100 of the watercraft. In some embodiments, an inner surface of the bonding flange 212 forms an outer limit of a first raceway 210 of the present invention.

In some embodiments, the shell defines a plurality of raceways extending along one or more portion of the shell, such as a one or more portion of the hull 120, the deck 110, or otherwise. In some embodiments, each raceway is configured to direct fluid during operation of the watercraft, such as during a turning maneuver, a wake (or other wave) plowing maneuver, a submarining maneuver, or the like, thereby causing such fluid to excerpt a net force upon the watercraft during such operation. In some embodiments, each raceway is configured such that the net force improves performance, safety, and/or stability of the watercraft and/or improves a user's ability to control the watercraft during such operation.

Figure 2:
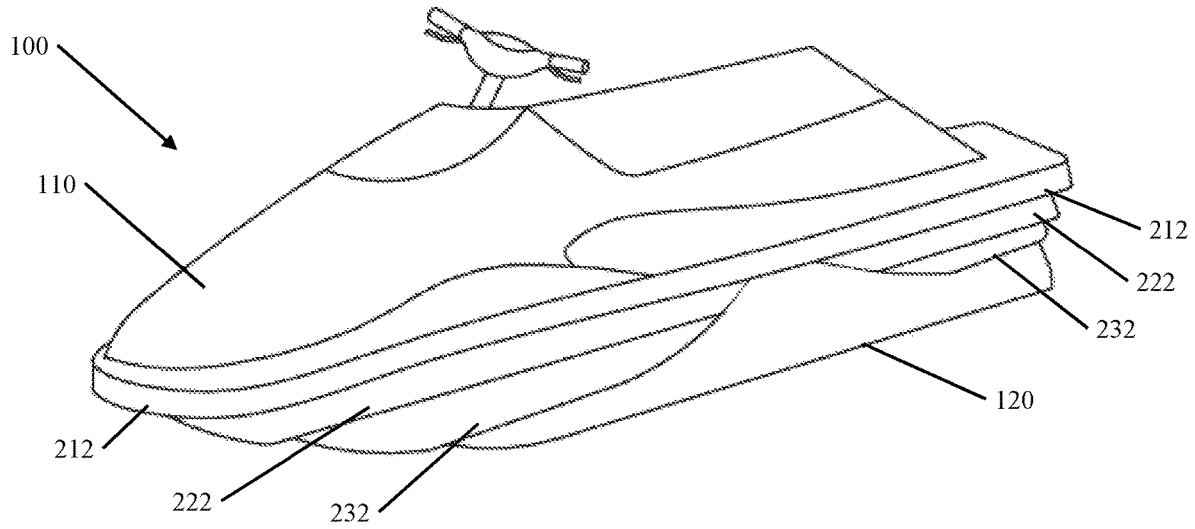
FIG. 2 is a perspective view of a first watercraft of the present invention.
Figure 3:
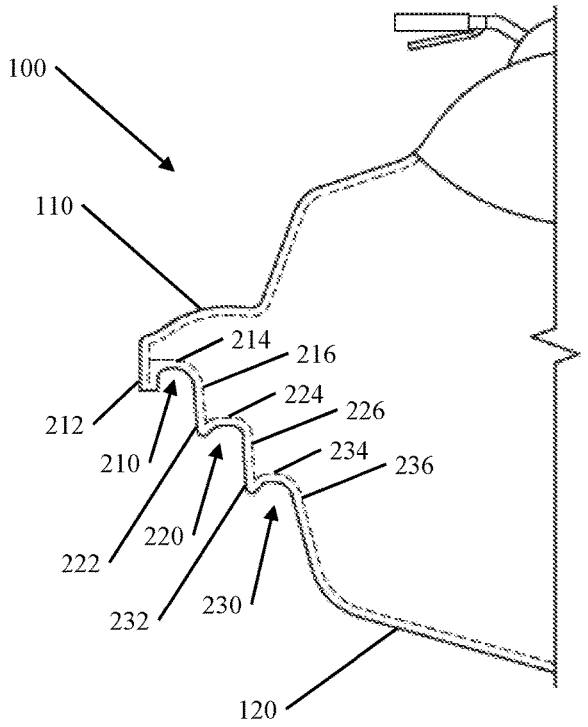
FIG. 3 is a partial sectional view of the first watercraft of FIG. 2.
Figure 4:
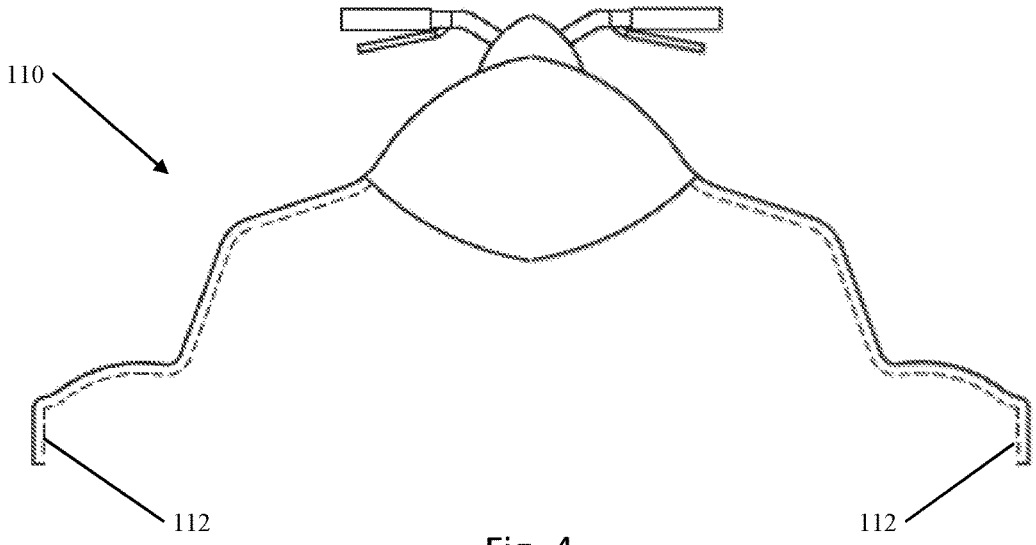
FIG. 4 is a sectional view of an upper portion of the first watercraft of FIG. 2.
Figure 5:
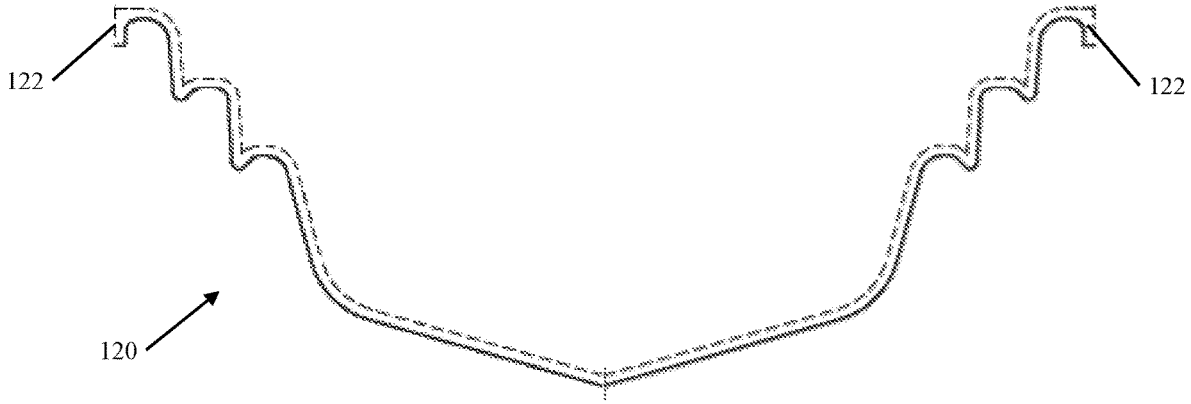
FIG. 5 is a sectional view of a lower portion of the first watercraft of FIG. 2.
Figure 6:
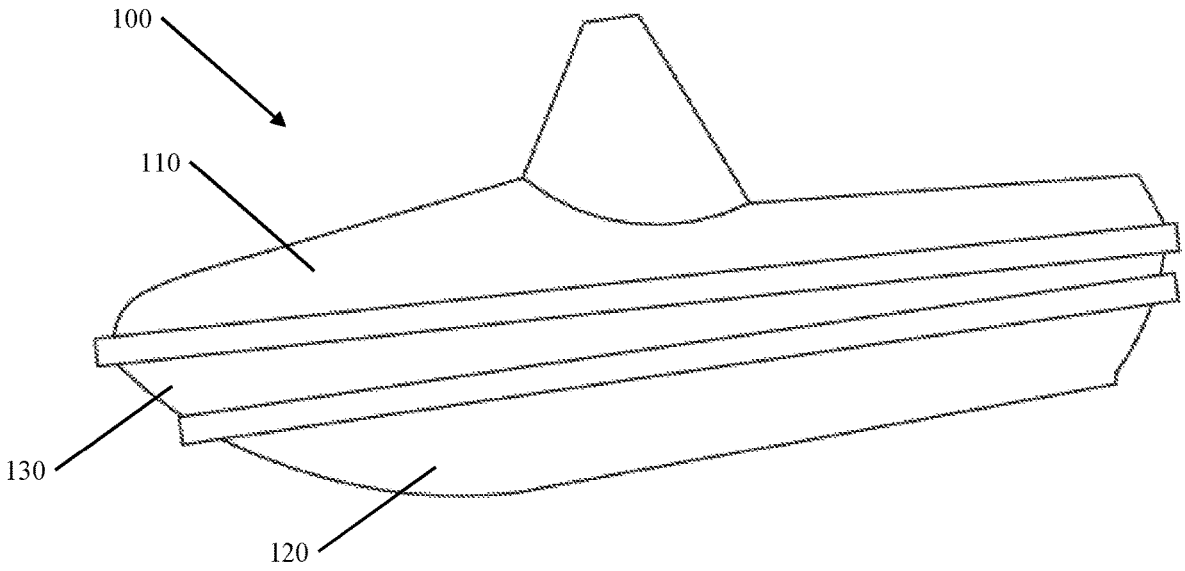
FIG. 6 is a perspective view of a second watercraft of the present invention.
Figure 7:
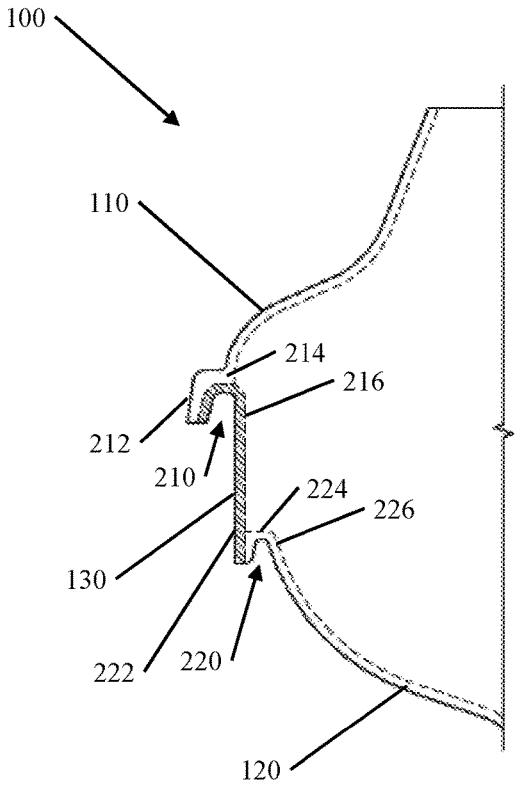
FIG. 7 is a partial sectional view of the second watercraft of FIG. 6.
Figure 8:
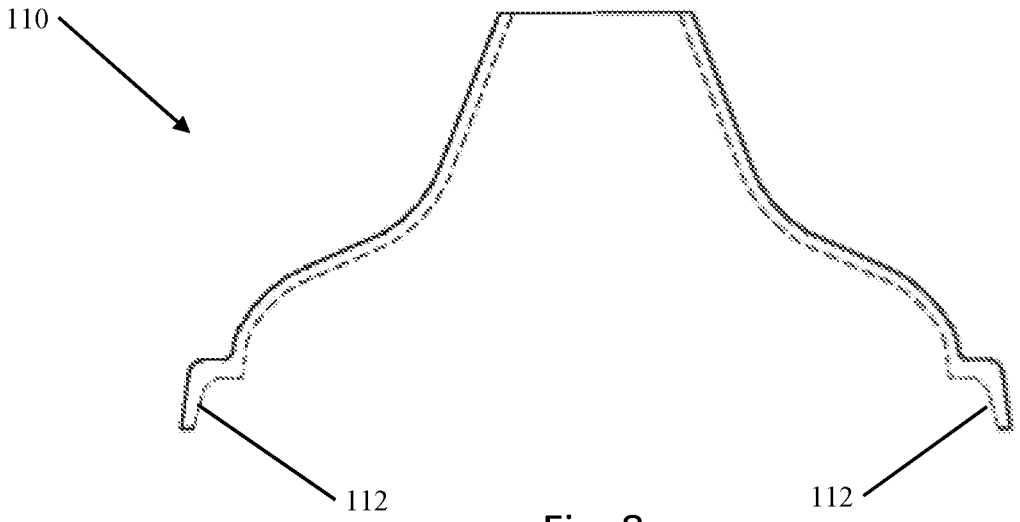
FIG. 8 is a sectional view of an upper portion of the second watercraft of FIG. 6.
Figure 9:
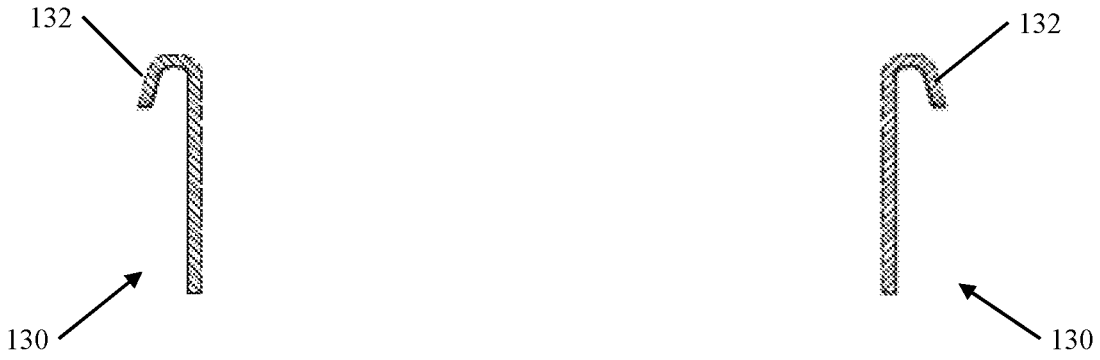
FIG. 9 is a sectional view of an intermediate portion of the second watercraft of FIG. 6.
Figure 10:
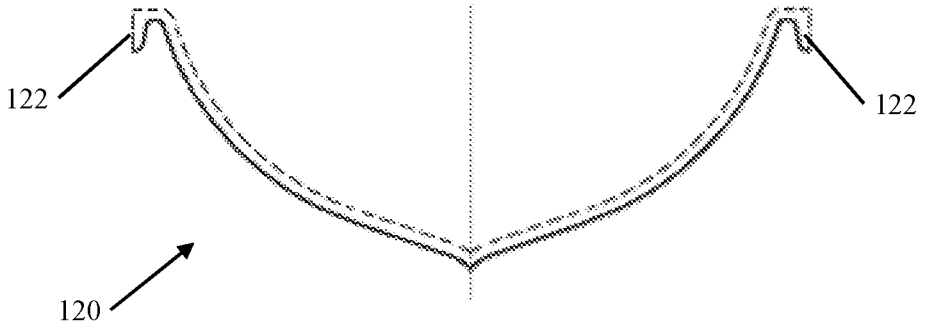
FIG. 10 is a sectional view of a lower portion of the second watercraft of FIG. 6.

Referring to FIGS. 2 and 3, some embodiments of the present invention include a first raceway 210 extending along at least a first portion of the shell 100. In some embodiments, the first raceway 210 extends along all or substantially all of a length of the watercraft. In some embodiments, the first raceway 210 is positioned just inboard of a first flange 212 (such as a bonding flange 212 or the like) such that an inner surface of the first flange 212 defines an outer limit of the first raceway 210. In some embodiments, an upper limit of the first raceway 210 is defined by a bottom surface of a first horizontal panel 214 extending generally horizontally inboard from the first flange 212. In some embodiments, an inner limit of the first raceway 210 is defined by an outer surface of a first vertical panel 216. In some embodiments, the first flange 212, the first horizontal panel 214, and the first vertical panel 216, combined, form a first channel having a closed top and an open bottom.

Still referring to FIGS. 2 and 3, some embodiments of the present invention include a second raceway 220 extending along at least a first and/or second portion of the shell 100. In some embodiments, a front portion of the second raceway 220 extends along all or substantially all of a front portion of the water craft. In some embodiments, a rear portion of the second raceway 220 extends along all or substantially all of a rear portion of the water craft. In some embodiments, the shell 100 defines a void positioned between front and rear portions of the second raceway 220. In some embodiments, the void is positioned at or near a pivot point of the watercraft, such as at or near a location of a rider of the watercraft. In some embodiments, the second raceway 220 is defined by a hull 120 of the watercraft.

In some embodiments, the second raceway 220 is positioned just inboard of a second flange 222 such that an inner surface of the second flange 222 defines an outer limit of the second raceway 220. In some embodiments, an upper limit of the second raceway 220 is defined by a bottom surface of a second horizontal panel 224 extending generally horizontally inboard from the second flange 222. In some embodiments, an inner limit of the second raceway 220 is defined by an outer surface of a second vertical panel 226. In some embodiments, the second flange 222, the second horizontal panel 224, and the second vertical panel 226, combined, form a second channel having a closed top and an open bottom.

Still referring to FIGS. 2 and 3, some embodiments of the present invention include a third raceway 230 extending along at least a first, second, and/or third portion of the shell 100. In some embodiments, a front portion of the third raceway 230 extends along all or substantially all of a front portion of the water craft. In some embodiments, a rear portion of the third raceway 230 extends along all or substantially all of a rear portion of the water craft. In some embodiments, the shell 100 defines a void positioned between front and rear portions of the third raceway 230. In some embodiments, the void is positioned at or near a pivot point of the watercraft, such as at or near a location of a rider of the watercraft. In some embodiments, the third raceway 230 is defined by a hull 120 of the watercraft.

In some embodiments, the third raceway 230 is positioned just inboard of a third flange 232 such that an inner surface of the third flange 232 defines an outer limit of the third raceway 230. In some embodiments, an upper limit of the third raceway 230 is defined by a bottom surface of a third horizontal panel 234 extending generally horizontally inboard from the third flange 232. In some embodiments, an inner limit of the third raceway 230 is defined by an outer surface of a third vertical panel 236. In some embodiments, the third flange 232, the third horizontal panel 234, and the third vertical panel 236, combined, form a third channel having a closed top and an open bottom.

In some embodiments, the shell 100 defines a plurality of raceways, such as first 210, second 220, and/or third 230 raceways, extending along one or more portion of the shell 100, such as first, second, and/or third portions of the shell. In some embodiments, a first flange 212 associated with a first raceway 210 extends along a first portion of a first side of the shell 100. In some embodiments, a second flange 222 associated with a second raceway 220 extends along at least one of the first portion and a second portion of the first side of the shell 100. In some embodiments, the first flange 212 (or at least a portion thereof) is vertically displaced from the second flange 222 (or at least a respective portion thereof). In some embodiments, the first flange 212 (or at least a portion thereof) is generally parallel with the second flange 222 (or at least a respective portion thereof). It will be appreciated that, in at least some embodiments, a second side of the shell 100 is substantially a mirror image of the first side of the shell 100.

In some embodiments, at least a portion of the first 212 and/or second 222 flange is generally parallel with, but laterally displaced from, a respective first 214 and/or second 224 vertical panel of the shell 100, thereby defining a width of a respective first 210 and/or second 220 raceway. In some embodiments, the first 212 and/or second 222 flange is angled away from a respective first 216 and/or second 226 vertical panel, thereby defining a void, such as a raceway. In some embodiments, the first 212 and/or second 222 flange is separable from the shell 100. In some such embodiments, the first 210 and/or second 220 raceway, or other void, is defined by attaching a respective first 212 and/or second 222 flange to the shell 100.

In some embodiments, the second flange 222 is vertically displaced downward from and/or inboard from the first flange 212. In some embodiments, the first flange 212 is formed by securing a bottom lip 112 of a deck 110 of the shell 100 to a top lip 122 of a hull 120 of the shell 100. In some embodiments, the second flange is defined by and/or attached to the hull 120. In some embodiments, the second flange 222 is formed by securing a bottom lip 112 of a deck 110 of the shell 100 to a top lip 122 of a hull 120 of the shell 100. In some embodiments, the first flange is defined by and/or attached to the deck 110.

In some embodiments, a third flange 232 associated with a third raceway 230 extends along at least one of the first portion, the second portion, and a third portion of the first side of the shell 100. In some embodiments, the first 212 and/or second 222 flange (or at least a portion of either) is vertically displaced from the third flange 232 (or at least a respective portion thereof). In some embodiments, the first 212 and/or second 222 flange (or at least a portion of either) is generally parallel with the third flange 232 (or at least a respective portion thereof).

In some embodiments, at least a portion of the third 232 flange is generally parallel with, but laterally displaced from, a respective third 234 vertical panel of the shell 100, thereby defining a width of a respective third 230 raceway. In some embodiments, the third flange 232 is angled away from a respective third vertical panel 236, thereby defining a void, such as a raceway. In some embodiments, the third flange 232 is separable from the shell 100. In some such embodiments, the third raceway 230, or other void, is defined by attaching a respective third flange 232 to the shell 100. It will be appreciated that some embodiments include fourth, fifth, or more flanges, raceways, or the like.

In some embodiments, the third flange 232 is vertically displaced downward from and/or inboard from the first 212 and second 222 flanges. In some embodiments, the third flange 232 is defined by and/or attached to the deck 110 of the shell 100. In some embodiments, the third flange 232 is formed by securing a bottom lip 112 of the deck 110 to a top lip 122 of the hull 120. In some embodiments, the third flange 232 is defined by and/or attached to the hull 120. In some embodiments, one or more of the first, second, third, or more flanges is defined by and/or attached to a portion of the watercraft other than by attaching the same to the deck 110 or the hull 120.

Referring to FIGS. 6-10, some embodiments of shells of the present invention include one or more intermediate panel 130. In some embodiments, the intermediate panel 130 extends between a deck 110 and a hull 120 of the shell 100. In some embodiments, a bottom lip 112 of the deck secures to a top lip 132 of the intermediate panel 130, thereby forming an upper bonding joint. In some embodiments, a top lip 122 of the deck secures to a bottom portion of the intermediate panel 130, thereby forming a lower bonding joint. In some embodiments, the upper and/or lower bonding joint forms at least part of a first, second, or other flange of the present invention and/or otherwise defines at least part of a first, second, or other raceway of the same. It will be appreciated that, in some embodiments, the intermediate panel 130 defines one or more flange and/or one or more flange is attached to the intermediate panel 130. It will further be appreciated that, in some embodiments, the intermediate panel is formed from a plurality of panels bonded together and/or formed together.

In some embodiments, the intermediate panel 130 is flexible and/or is otherwise designed to facilitate shock absorption during use of the watercraft. In some such embodiments, at least a first portion of the intermediate panel 130 is more flexible than a corresponding portion of the deck 110 and/or hull 120.

In some embodiments, the shell 100 defines a plurality of downward facing surfaces for increasing safety and stability of the watercraft. In some embodiments, at least part of one or more downward facing surface is defined by a bottom surface of a horizontal panel of a respective channel, such as a first 214, second 224, and/or third 234 horizontal panel of a respective first, second, and/or third channel of the present invention. In some embodiments, one or more downward facing surface is defined, at least in part, by an inner/lower surface of one or more flange of the present invention.

In some embodiments, water pushes off of one or more downward facing surface during operation of the watercraft, thereby exerting a force upon the watercraft, such as by excerpting a load directly upon the shell 100 of the watercraft and/or by excerpting a first force upon the shell 100 of the watercraft by way of exerting a force upon a flange or other structure attached to the shell 100. In some embodiments, the watercraft is configured so as to eliminate or otherwise reduce an opposed second force from acting upon the shell 100, directly or otherwise. In some embodiments, the shell includes one or more panel, such as one or more vertical panel, for preventing or otherwise inhibiting water from excerpting an opposed force on at least a portion of an opposed upward facing surface. In some embodiments, shells of the present invention define an interior area, at least a portion of an upward facing surface opposed to the downward facing surface being positioned within the interior area.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A watercraft comprising:

a hull forming a bottom portion of a shell of the watercraft;

a deck forming a top portion of said shell;

a first flange extending along a first portion of a first side of said shell; and a second flange extending along at least one of said first portion and a second portion of said first side of said shell, wherein at least a first segment of said first flange is vertically displaced from at least a first segment of said second flange, and wherein said first and second flanges define respective first and second raceways, each raceway having an open bottom for receiving water during a first maneuver, wherein said first raceway and said second raceway are defined by respective first and second channels having respective first and second horizontal portions extending between respective opposed inner and outer vertical portions, and wherein said inner vertical portion of said first channel extends to said outer vertical portion of said second channel such that an upper surface of said second horizontal portion is positioned within an interior area of said shell, the first maneuver being one of banking the watercraft during a turn and plowing the watercraft through a wave.

2. The watercraft of claim 1, wherein said first flange is formed by securing a bottom lip of said deck to a top lip of said hull.

3. The watercraft of claim 2, wherein said second flange is defined by said hull.

4. A watercraft comprising:

a hull forming a bottom portion of a shell of the watercraft;

a deck forming a top portion of said shell;

a first flange extending along a first portion of a first side of said shell;

a second flange extending along at least one of said first portion and a second portion of said first side of said shell; and an intermediate panel extending between said deck and said hull, said intermediate panel defining said first portion of said first side of said shell, wherein at least a first segment of said first flange is vertically displaced from at least a first segment of said second flange, wherein said first flange is formed by securing a bottom lip of said deck to an upper portion of said intermediate panel, wherein said second flange is formed by securing a top lip of said hull to a lower portion of said intermediate panel, wherein said intermediate panel defines an intermediate flange, a first segment of said intermediate flange being parallel with, and vertically displaced from, a first segment of at least one of said first and second flanges, and wherein said first, second, and intermediate flanges define respective first, second, and intermediate raceways, each raceway having an open bottom for receiving water during a first maneuver, the first maneuver being one of banking the watercraft during a turn and plowing the watercraft through a wave.

5. The watercraft of claim 4, wherein said first raceway and said intermediate raceway are defined by respective first and intermediate channels having respective first and intermediate horizontal portions extending between respective opposed inner and outer vertical portions, said inner vertical portion of said first channel extending to said outer vertical portion of said intermediate channel such that an upper surface of said intermediate horizontal portion is positioned within an interior area of said shell, the first maneuver being one of banking the watercraft during a turn and plowing the watercraft through a wave.

6. The watercraft of claim 5, wherein at least a first portion of said intermediate panel is more flexible than a corresponding portion of said deck and said hull such that said intermediate panel serves as a shock absorber for the watercraft.

7. A watercraft comprising:

a hull forming a bottom portion of a shell of the watercraft;

a deck forming a top portion of said shell;

a first flange extending along a first portion of a first side of said shell;

a second flange extending along at least one of said first portion and a second portion of said first side of said shell; and an intermediate panel extending between said deck and said hull, said intermediate panel defining said first portion of said first side of said shell, wherein at least a first segment of said first flange is vertically displaced from at least a first segment of said second flange, wherein said first flange is formed by securing a bottom lip of said deck to an upper portion of said intermediate panel, wherein said second flange is formed by securing a top lip of said hull to a lower portion of said intermediate panel, and wherein at least a first portion of said intermediate panel is more flexible than a corresponding portion of said deck and said hull such that said intermediate panel serves as a shock absorber for the watercraft.

8. A watercraft comprising:

a hull forming a bottom portion of a shell of the watercraft;

a deck forming a top portion of said shell;

a first flange extending along a first portion of a first side of said shell; and a second flange extending along at least one of said first portion and a second portion of said first side of said shell, wherein at least a first segment of said first flange is vertically displaced from at least a first segment of said second flange, and wherein said first portion of said first side of said shell is more flexible than adjacent portions of said shell such that said first portion of said shell serves as a shock absorber for the watercraft.

9. The watercraft of claim 8, wherein said first and second flanges define respective first and second raceways, each raceway having an open bottom for receiving water during a first maneuver, wherein said first raceway and said second raceway are defined by respective first and second channels having respective first and second horizontal portions extending between respective opposed inner and outer vertical portions, and wherein said inner vertical portion of said first channel extends to said outer vertical portion of said second channel such that an upper surface of said second horizontal portion is positioned within an interior area of said shell, the first maneuver being one of banking the watercraft during a turn and plowing the watercraft through a wave.

10. A watercraft of comprising a shell defining an interior area, the shell comprising:

a hull forming a bottom portion of said shell;

a deck forming a top portion of said shell;

a first flange; and a second flange, wherein said shell defines a plurality of downward facing surfaces, each downward facing surface being configured to repel water during operation of the watercraft such that the water excerpts a first force upon the shell during a first maneuver, wherein the shell is configured to reduce an opposed second force upon the shell during the first maneuver, wherein the first maneuver is one of banking the watercraft during a turn and plowing the watercraft through a wave, and wherein said first and second flanges are associated with respective first and second downward facing surfaces, the first and second flanges being configured to direct water towards respective first and second downward facing surfaces.

11. The watercraft of claim 10, wherein the watercraft is configured to direct water towards each downward facing surface upon a water level reaching respective downward facing surfaces during the first maneuver.

12. The watercraft of claim 10, wherein water is directed away from at least a portion of an opposed upward facing surface during the first maneuver.

13. The watercraft of claim 12, wherein at least a portion of said upward facing surface is positioned within said interior area of said shell.

14. The watercraft of claim 13, further comprising first and second channels defining respective first and second raceways, said first and second raceways comprising respective first and second horizontal portions extending between respective opposed inner and outer vertical portions, wherein opposed upper and lower surfaces of said first and second horizontal portions define at least part of respective first and second upward and downward facing surfaces, respectively, and wherein said inner vertical portion of said first channel extends to said outer vertical portion of said second channel such that said upper surface of said second horizontal portion is positioned within said interior area of said shell.

15. A method of operating a watercraft, the method comprising performing a first maneuver, wherein performing the first maneuver causes a change in water level relative to the shell, wherein the change in water level causes the water level to be higher than a downward facing surface and an opposed upward facing surface along at least a portion of the length of the watercraft, wherein the watercraft is configured to direct water towards the downward facing surface during the first maneuver, thereby causing the water to excerpt a first force upon the shell, and wherein the watercraft is configured to direct water away from at least a portion of the upward facing surface during the first maneuver, thereby preventing the water from excerpting an opposed second force upon the shell, wherein the first maneuver is one of banking the watercraft during a turn and plowing the watercraft through a wave, and wherein the shell comprises a horizontal portion extending between opposed inner and outer vertical portions, wherein opposed upper and lower surfaces of the second horizontal portion define at least part of respective upward and downward facing surfaces, and wherein the outer vertical portion extends vertically above the horizontal portion such that the upper surface of the horizontal portion is positioned within an interior area of the shell.

16. The watercraft of claim 8, wherein said first flange is formed by securing a bottom lip of said deck to a top lip of said hull.

17. The watercraft of claim 16, wherein said second flange is defined by said hull.

18. The watercraft of claim 10, wherein said first flange is formed by securing a bottom lip of said deck to a top lip of said hull.

19. The watercraft of claim 18, wherein said second flange is defined by said hull.

* * * * *